US006019158A

United States Patent [19]

Soderstrom et al.

[11] Patent Number: 6,019,158

[45] Date of Patent: Feb. 1, 2000

[54] INVESTMENT CASTING USING POUR CUP RESERVOIR WITH INVERTED MELT FEED GATE

[75] Inventors: Mark L. Soderstrom, Fruitport; Dale A. Grumm, Zeeland; Lester G. Striker, Whitehall, all of Mich.

[73] Assignee: Howmet Research Corporation, Whitehall, Mich.

[21] Appl. No.: 09/253,982

[22] Filed: May 14, 1998

[51] Int. Cl.[7] ..... B22D 18/00; B22D 23/00; B22D 45/00

[52] U.S. Cl. ..... 164/133; 164/119; 164/134; 164/284; 164/337

[58] Field of Search ..... 164/119, 133, 164/134, 284, 337

[56] References Cited

U.S. PATENT DOCUMENTS

| | | | |
|---|---|---|---|
| 969,539 | 9/1910 | Kitchen . | |
| 1,320,824 | 11/1919 | Bailey et al. . | |
| 1,690,750 | 11/1928 | Moyer . | |
| 1,758,380 | 5/1930 | Spiro . | |
| 1,962,456 | 6/1934 | Myers . | |
| 3,228,073 | 1/1966 | Harrison et al. . | |
| 3,420,291 | 1/1969 | Chandley et al. | 164/66.1 |
| 3,853,635 | 12/1974 | Demendi . | |
| 3,865,175 | 2/1975 | Listhuber et al. . | |
| 3,892,272 | 7/1975 | Troy et al. | 164/306 |
| 4,049,041 | 9/1977 | Nikolov et al. | 164/120 |
| 4,186,791 | 2/1980 | Sladkoshteev et al. | 164/66.1 |
| 4,425,932 | 1/1984 | Herman | 137/143 |
| 4,478,270 | 10/1984 | Rosenthal et al. | 164/254 |
| 4,593,711 | 6/1986 | Caugherty | 164/337 |
| 4,733,714 | 3/1988 | Smith | 164/130 |
| 4,741,463 | 5/1988 | Müller et al. | 164/134 X |
| 4,830,090 | 5/1989 | Takeuchi et al. | 164/488 |
| 4,832,105 | 5/1989 | Nagan et al. | 164/61 |
| 5,058,653 | 10/1991 | Garat | 164/34 |
| 5,109,914 | 5/1992 | Kidd et al. | 164/113 |
| 5,181,551 | 1/1993 | Kidd et al. | 164/113 |
| 5,199,482 | 4/1993 | Rühle | 164/120 |
| 5,299,619 | 4/1994 | Chandley et al. | 164/53 |
| 5,301,739 | 4/1994 | Cook | 164/97 |
| 5,335,711 | 8/1994 | Paine | 164/66.1 |
| 5,348,071 | 9/1994 | Cook | 164/284 X |
| 5,388,633 | 2/1995 | Mercer, II et al. | 164/457 |
| 5,390,724 | 2/1995 | Yamauchi et al. | 164/147.1 |

*Primary Examiner*—J. Reed Batten, Jr.
*Attorney, Agent, or Firm*—Edward J. Timmer

[57] ABSTRACT

A ceramic investment mold is disposed in a casting chamber and communicates with a pour cup melt reservoir connected to the mold and having a reservoir volume for holding enough melt to fill the mold. The melt pour cup reservoir is communicated to the mold via an inverted loop feed gate so that the melt is fed from a lower region of the reservoir through the inverted loop feed gate to the mold upon gas pressurization of the reservoir. The loop feed gate is configured to have a loop region above the melt level in the reservoir so as to prevent melt flow from the reservoir to the more mold cavities in the absence of reservoir pressurization. While residing in the pour cup reservoir, oxides and other inclusion-forming particles in the melt can float to the upper surface of the melt, whereby the melt fed from the lower region of the reservoir to the mold via the inverted loop melt feed gate includes reduced amount of inclusion-forming particles. After the melt is introduced into the pour cup, a pressure cap can be positioned in sealing engagement with the pour cup to provide selective or local gas pressure on the melt in the pour cup reservoir to force the melt in the reservoir through the inverted loop feed gate into the mold cavities to fill same.

8 Claims, 4 Drawing Sheets

INVESTMENT CASTING USING POUR CUP RESERVOIR WITH INVERTED MELT FEED GATE

This application is related to copending application Ser. No. 09/079,129 filed May 14, 1998, of common assignee herewith.

BACKGROUND OF THE INVENTION

The present invention relates to investment casting of metals and alloys using a ceramic investment mold and a melt pour cup reservoir connected to the mold by an inverted melt feed gate to provide for bottom feeding of the melt from the reservoir.

BACKGROUND OF THE INVENTION

In the manufacture of components, such as nickel base superalloy turbine blades and vanes, for gas turbine engines, investment casting techniques have been employed in the past to produce equiaxed, single crystal or columnar grain castings having improved mechanical properties at high temperatures encountered in the turbine section of the engine.

In the manufacture of turbine blades and vanes for modern, high thrust gas turbine engines, there has been a continuing demand by gas turbine manufactures for internally cooled blades and vanes having complex, internal cooling passages including such features as pedestals, turbulators, and turning vanes in the passages in a manner to provide desired cooling of the blade or vane. These small cast internal surface features typically are formed by including a complex ceramic core in the mold cavity in which the melt is cast. The presence of the complex core having small dimensioned surface features to form pedestals, turbulators, and turning vanes or other internal surface features renders filling of the mold cavity about the core with melt more difficult and more prone to inconsistency. Wettable ceramics and increased metallostatic head on the mold and higher preheat temperatures have been used in an attempt to improve mold filling and reduce localized voids in such situations, but these are costly and may be restricted by physical size of the casting apparatus. Moreover, to reduce casting weight, gas turbine engine manufacturers require thinner airfoil wall thickness and smaller cast to size external features that are not possible or very difficult to fill with molten metal.

U.S. Pat. No. 5,592,984 describes a method of investment casting gas turbine engine blades and vanes and other components wherein a ceramic investment mold is disposed in a casting furnace in a casting chamber and filled with the melt with the casting chamber being gas pressurized rapidly enough after casting to reduce localized void regions present in the melt as a result of surface tension effects between the melt and mold components such as ceramic mold and/or core.

Moreover, there is a continuing desire to improve the cleanliness of the melt supplied to the mold cavities in particular to reduce oxide and other inclusion-forming particles in the melt that constitute harmful inclusions in the casting that adversely affect its mechanical properties.

It is an object of the present invention to provide method and apparatus for investment casting using an investment mold and a melt pour cup reservoir communicated to the mold by an inverted melt feed gate to provide for cleaner bottom feeding of the melt to the mold and better filling of the mold in the event the pour cup reservoir is gas pressurized.

SUMMARY OF THE INVENTION

The present invention provides method as well as apparatus for investment casting wherein a ceramic investment mold is disposed in a casting chamber, and a pour cup melt reservoir is communicated to the mold and includes a reservoir volume for holding at least enough melt, preferably an excess of melt, to fill the mold. The melt pour cup reservoir is communicated to the mold via an inverted loop feed passage or gate so that the melt is fed from a lower region of the reservoir through the inverted loop feed gate to the mold under gas pressurization of the reservoir. However, the loop feed gate is configured to have a loop passage region above the maximum melt level in the reservoir so as to prevent melt flow from the reservoir to the mold cavities in the absence of reservoir pressurization. While residing in the pour cup reservoir, oxides and other inclusion-forming particles in the melt can float to the upper surface of the melt, whereby the melt bottom fed from the lower region of the reservoir to the mold via the inverted loop melt feed gate has a reduced amount of inclusion-forming particles therein. An optional molten metal filter can be used to remove or reduce inclusions in the molten metal fed to the mold without a detrimental loss of molten metal flow since the metal is fed under gas pressurization.

After the melt is introduced into the pour cup reservoir, a pressure cap or other gas pressurizing means can be positioned in sealing engagement with the pour cup to provide selective or local gas pressure on the melt in the pour cup reservoir to force the cleaner bottom melt through the inverted loop feed passage or gate into the mold cavities to fill same, leaving some dirty melt (melt contaminated with inclusion-forming particles) proximate the upper melt surface remaining in the pour cup. The casting chamber can be maintained under relative vacuum or at a different pressure from that in the pour cup reservoir while the pressure is applied on the melt in the pour cup reservoir.

The present invention aids in filling of fine details in the mold cavity that are defined by internal mold surface features and/or core surface features that are otherwise difficult to fill with the melt. The present invention also aids in filling the mold with melt having reduced amounts of inclusion-forming particles to provide cleaner castings. The present invention is advantageous in that the pressurizing gas is not introduced into the casting chamber, which can be maintained under relative vacuum (subatmospheric pressure) or at a different pressure from that present in the pour cup reservoir.

DETAILED DESCRIPTION OF THE INVENTION

Figure 1:
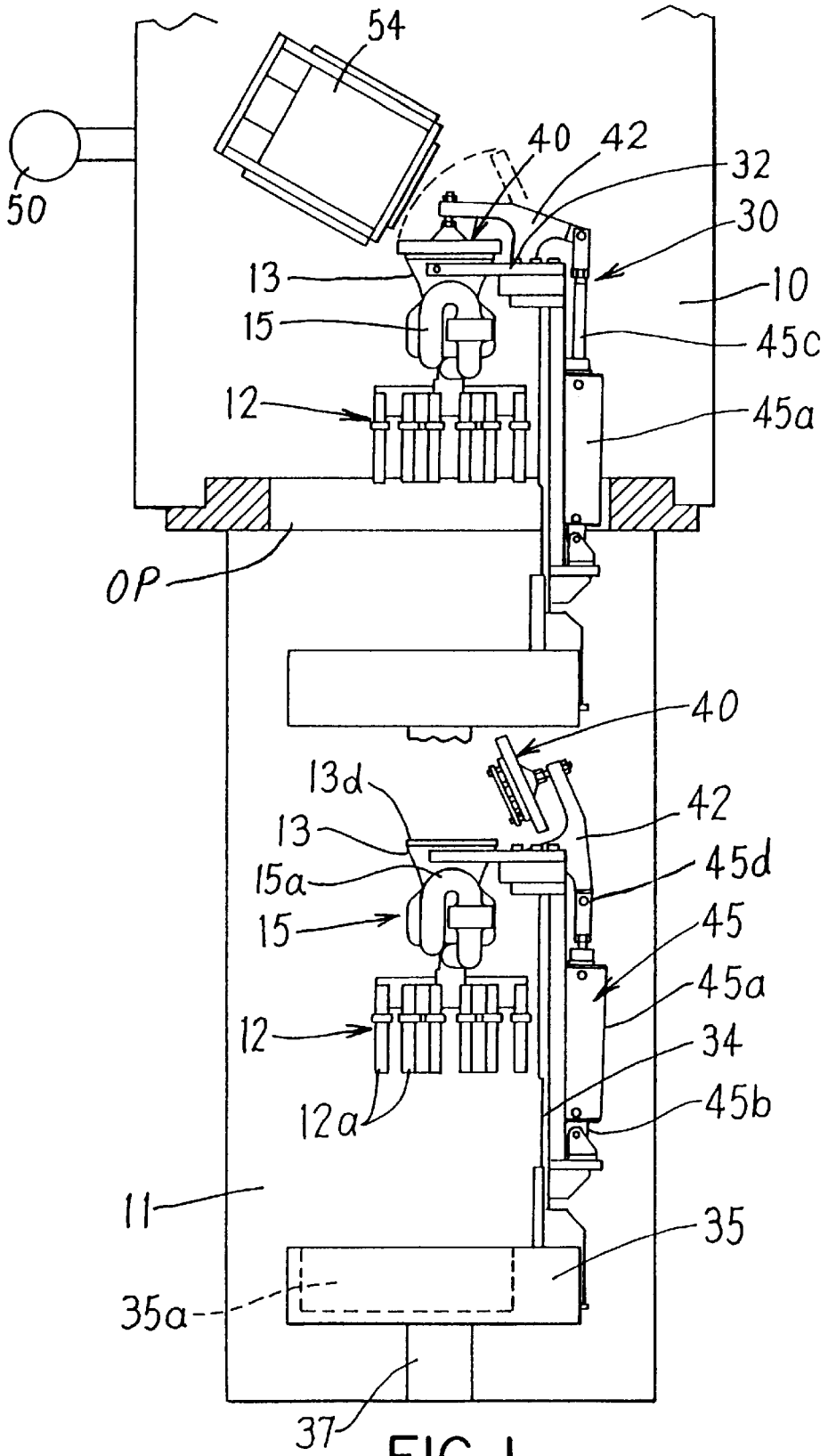
FIG. 1 is a schematic view of casting apparatus in accordance with an embodiment of the invention.

The present invention provides method and apparatus for investment casting of metals and alloys and is especially useful, although not limited, to casting nickel, cobalt and iron base superalloys with equiaxed, single crystal, or columnar grain microstructures as well as titanium and its alloys and other commonly used metal and alloys. For example only, referring to FIGS. 1–3, the present invention can be practiced to make equiaxed grain castings which may be cored or not to produce complex internal passages therein in casting equipment which includes a casting chamber 10 and mold chamber 11 communicated by opening OP. A porous, gas permeable ceramic investment shell mold 12 is positioned in the casting chamber 10 in a manner described below.

The mold 12 comprises a mold cluster having a plurality of mold cavity-forming sections 12*a* each having a mold cavity (e.g. mold cavity 12*c* shown schematically in FIG. 3) which is filled with melt that is solidified to form a casting in each mold cavity. The mold cavity-forming sections 12*a* each can have a ceramic core (not shown) positioned therein to form internal passages and other features in the casting.

In accordance with one illustrative embodiment of the present invention, the mold 12 is connected or otherwise communicated to a common ceramic pour cup 13 having a pour cup reservoir 13*a* with an internal volume to receive and hold at least enough melt to fill the mold cavities with melt. For example, the volume of the pour cup reservoir 13*a* would be slightly larger than the mold cavities to be filled. The pour cup 13 is greatly enlarged in size and internal volume as compared to pour cup structures used in the past that merely functioned to receive and conduct the melt to the mold cavity-forming sections 12*a* without having to hold a sufficient amount of melt to fill the mold cavities.

The pour cup reservoir 13*a* is connected or otherwise communicated to the mold 12 for melt flow via an inverted loop feed passage or gate 15 and one or more lateral runners 17 so that the melt is fed from a lower region 13*b* of the reservoir 13*a* through the inverted loop feed passage or gate 15 and runners 17 to the mold cavities 12*c* upon gas pressurization of the pour cup reservoir in a manner described below. To this end, the inverted loop feed passage or gate 15 communicates with the internal reservoir 13*a* via an opening 13*c* formed in the bottom wall of the pour cup 13.

The loop feed gate 15 is configured to have an uppermost loop passage section 15*c* above the maximum level L of the melt in the reservoir 13*a* such that flow of the melt from the reservoir to the mold 12 is prevented by the loop feed gate 15 in the absence of reservoir pressurization.

In particular, the loop feed gate 15 includes an ascending section 15*a* communicated to the bottom opening 13*c* of the reservoir 13*a*, the uppermost loop section 15*c*, a descending section 15*b* interconnected by the uppermost loop section 15*c* to ascending section 15*a*, and a lateral section 15*d* that communicates to the descending section 15*b* and to a mold down sprue 19 in turn communicated to the runners 17 leading to the mold cavity-forming sections 12*a*.

The pour cup reservoir 13 receives the melt from crucible 54 disposed in the casting chamber 10. An induction coil (not shown) is disposed about the crucible 54 to heat and melt the charge of metal or alloy to form the melt to be cast. The melt typically is heated to a superheat temperature selected in dependence on the metal or alloy being cast.

While the melt resides in the pour cup reservoir 13*a*, oxides and other inclusion-forming particles in the melt can float to and segregate proximate the upper surface or level L of the melt such that the melt fed from the lower region 13*b* of the reservoir 13*a* to the mold 12 via the inverted loop melt feed gate 15 includes reduced amounts of inclusion-forming particles to thereby produce cleaner castings. One or more conventional ceramic molten metal filters 80 (one shown) also can be included in the loop 15, or the runners 17 or at other locations of melt flow to remove and reduce inclusion-forming particles in the molten metal.

The casting chamber 10 is evacuable by a vacuum pump 50 to a vacuum level of 15 microns or less for casting such alloys as nickel, cobalt, or iron base superalloys as well as titanium and its alloys. The mold 12/pour cup 13 positioned in the casting chamber 10 will be evacuated as a result of the mold being gas permeable.

The mold 12 typically comprises a ceramic investment shell mold cluster having the features described above and formed by the well known lost wax process wherein a wax or other fugitive pattern of the mold is dipped repeatedly in ceramic slurry, drained, and then stuccoed with coarse ceramic stucco to build up the desired shell mold thickness on the pattern. The pattern then is removed from the invested shell mold, and the shell mold is fired at elevated temperature to develop adequate mold strength for casting. Investment shell molds formed in this manner exhibit porosity and substantial permeability to gas as a result. The ceramic pour cup 13 and ceramic inverted loop feed passage or gate 15 are formed in similar manner using the lost wax process. The pour cup 13 can be formed separately from the mold 12 and communicated thereto with or without mechanical connection thereto, or it can be formed integrally with the mold using lost wax techniques.

Figure 2:
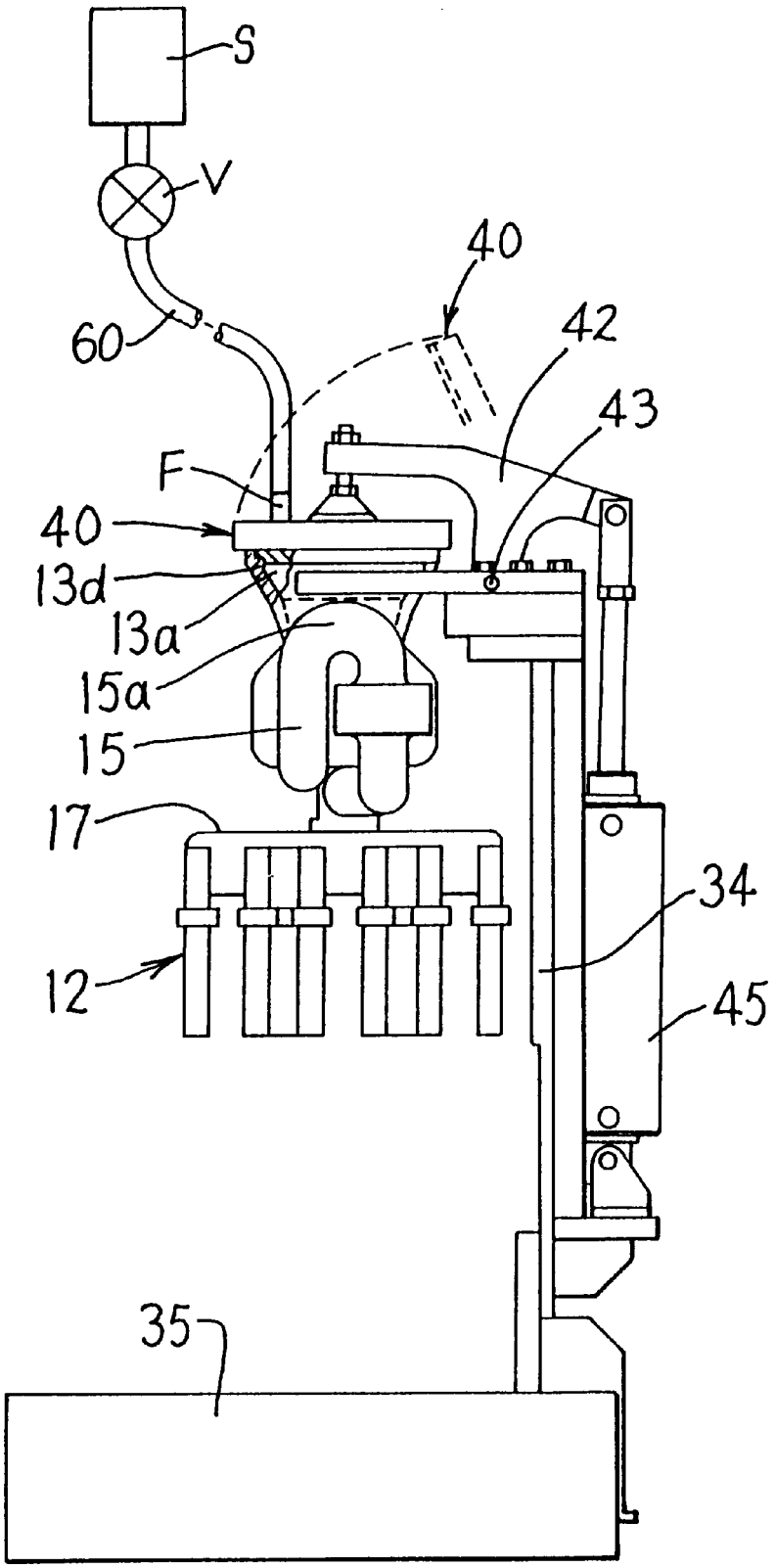
FIG. 2 is an enlarged elevational view of the apparatus features in accordance with an embodiment of the present invention for bottom feeding melt to the mold cavities.
Figure 3:
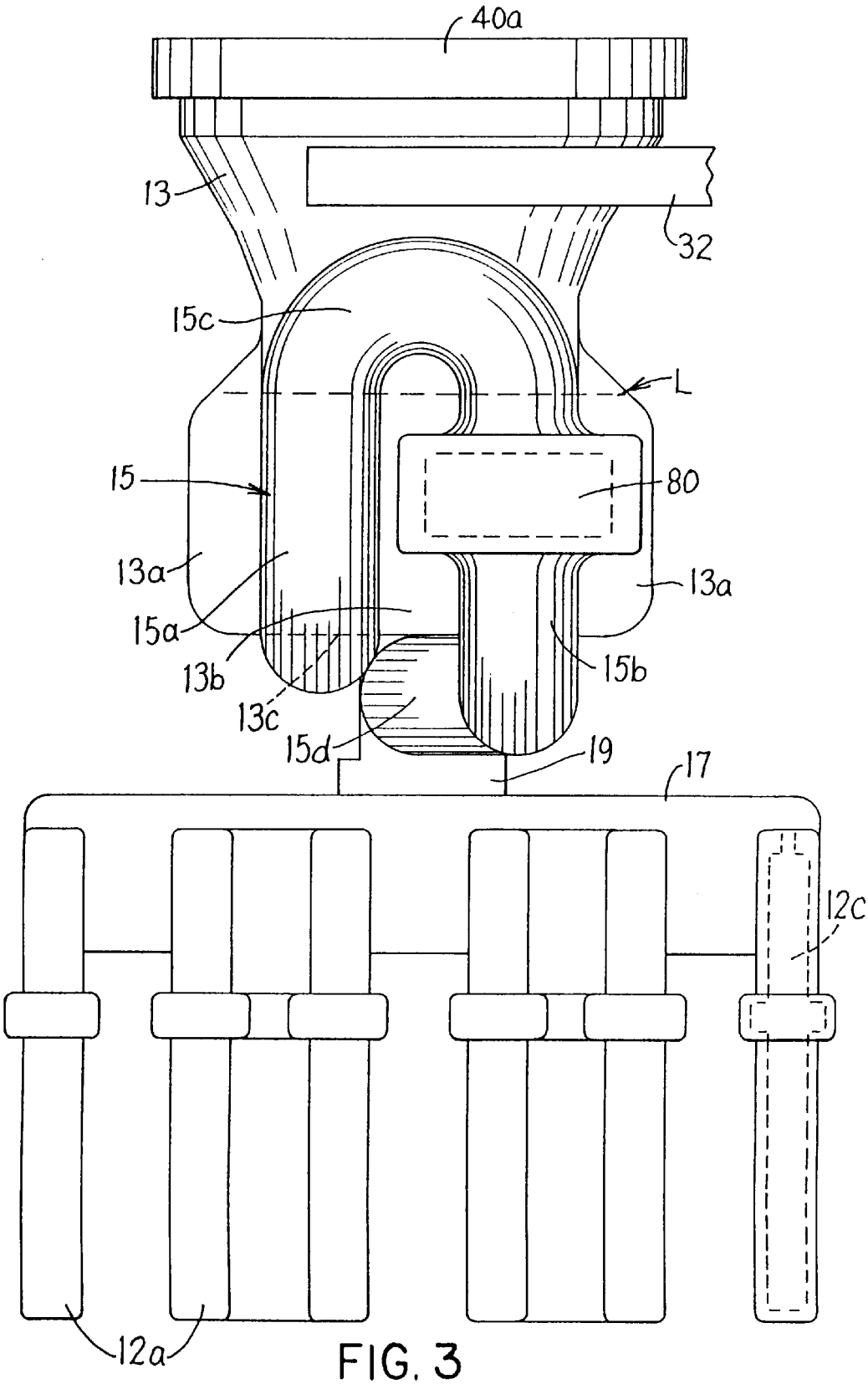
FIG. 3 is an enlarged elevational view of a ceramic investment casting mold for practicing an embodiment of the invention.

The mold 12 and pour cup 13 are positioned on a holding device 30 comprising a collar 32 disposed at least partially about the pour cup 13 as shown in FIG. 2. The holding collar 32 is supported on an upstanding support member 34 itself mounted on a base 35 that rests on a ram 37 of a hydraulic or other elevator that moves the mold between the mold loading/unloading chamber 11 and casting chamber 10 thereabove. The base 35 defines a receptacle 35*a* to catch debris that may fall from the mold 12 as well as melt splatter during pouring of the melt from the crucible 54 into the mold pour cup 12*b*.

Figure 4:
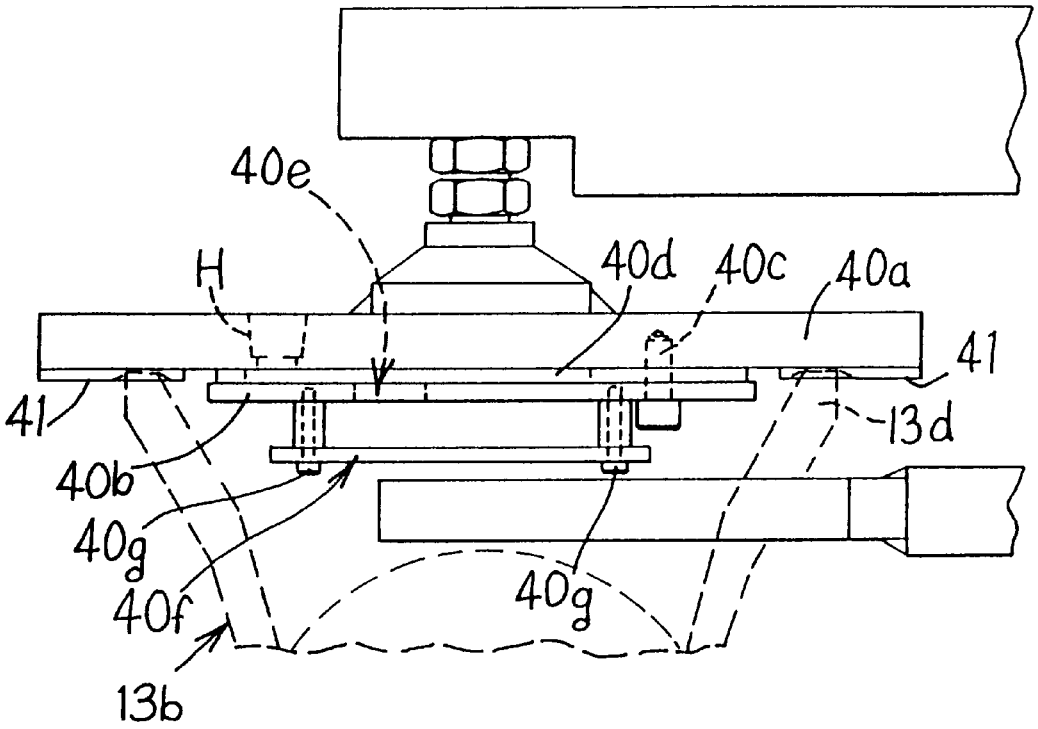
FIG. 4 is a partial enlarged elevational view of the pressure cap.

A pressure cap 40 is shown in FIGS. 1, 2 and 4 disposed on a pivoting mechanism having pivotal cap support member 42, which is pivotally mounted on the upstanding support member 34 by pivot pin 43. A pneumatic or other fluid actuator 45 is mounted on the upstanding support member 34 to pivot the cap support member 42 about pivot pin 43. To this end, the actuator includes a fluid cylinder 45*a* having a lower end mounted on the support member 34 by a pivot connection 45*b* and a piston rod 45*c* that is connected to the cap support member 42 by a pivot connection 45*d*.

The fluid actuator 45 is actuated to move the pressure cap 40 to a generally horizontal sealing position shown in solid lines in FIG. 2 in sealing engagement with the pour cup 13 and a non-sealing position shown in dashed lines away from the pour cup 13 with the pressure cap 40 oriented in an inclined orientation.

The pressure cap 40 includes a first plate 40*a* and a second annular plate 40*b* bolted thereto by bolts 40*c* with the first plate 40*a* carrying a flat and annular fiber gasket 41 (e.g. aluminum silicate fiber gasket) as shown in FIG. 4 that is pressed on and in engagement with the annular pour cup lip 13*d* when the pressure cap is in the solid line position shown in FIGS. 2 and 4. A gas manifold 40*d* is defined by plates 40*a*, 40*b*. The manifold 40*d* includes an outlet orifice or opening 40*e* for directing the inert gas against a lower gas deflector plate 40*f* spaced therefrom by a plurality of stand-offs 40*g* bolted to plate 40*b*, FIG. 4, so that the inert gas is forced to the sides of the pour cup and can expand uniformly downward onto the molten metal therein. In operation, the pressure cap 40 is moved by the aforementioned pivoting mechanism to sealingly press on the annular pour cup lip 13*d* of the hot mold after the melt is introduced from the crucible 54 into the pour cup.

The pressure cap 40 includes a threaded hole H for receiving fitting F to which a flexible conduit 60 is connected. The flexible conduit 60 is connected to a source S of pressurized inert gas (e.g. a conventional argon cylinder) disposed outside the chamber 10 by opening a valve V also disposed outside the chamber 10 between the conduit 60 and source 60. The source S and the valve V are stationary while the flexible conduit 60 travels up/down between chambers 10, 11 with the pressure cap 40. Chamber 11 is a mold loading and unloading chamber.

After the melt is introduced from the crucible 54 into the preheated pour cup reservoir 13*a* communicated to preheated mold 12, the pressure cap 40 is moved by the aforementioned pivoting mechanism to sealingly press on the annular pour cup lip 13*d*. The melt resides in the pour cup reservoir 13*a* for a preselected time as short as possible to maintain the melt temperature (e.g. one second or less) under a relative vacuum (e.g. 15 microns) in the casting chamber 10. Oxides and other inclusion-forming particles in the melt float to the upper surface or level of the melt while it resides in the reservoir 13*a* and is fed to the mold 12 via loop feed gate 15. The melt is bottom fed from the lower region 13*b* of the reservoir 13 to the mold 12 via the inverted loop melt feed gate 15 so that the melt supplied to the mold cavity-forming sections 12*a* includes reduced amounts of inclusion-forming particles.

To this end, after the pressure cap 40 is sealed on the pour cup lip 13*d*, the gas conduit 60 that extends to the pressure cap plate 40*a* is communicated to the source S of pressurized inert gas by opening valve V to thereby introduce localized inert gas pressure on the melt residing in the pour cup reservoir 13*a* at the level L. An inert gas pressure of 0.1 to 2.0 atmospheres can be provided on the melt residing in the pour cup reservoir 13*a* to this end effective to force the melt through the bottom pour cup opening 13*c* and through the inverted loop feed gate 15 into the mold cavity-forming sections 12*a* to fill them with the melt having reduced amounts of inclusion-forming particles. The dirty melt proximate the upper melt surface or level L is not fed to the mold cavities since it contains the segregated inclusion-forming particles.

Moreover, if the pour cup 13 and mold 12 are connected as shown, the pressure applied to the melt residing in the pour cup reservoir 13*a* also aids or enhances filling of fine details in the mold cavity 12*a* defined by the internal mold surface features and/or core surface features that are otherwise difficult to fill with the melt. The fiber sealing gasket 41 sealingly engaged on the pour cup lip 13*d* minimizes leakage of inert gas into the casting chamber 10 at the same time so that the casting chamber 10 can be maintained under relative vacuum by operation of vacuum pump 50 while the pressure cap 40 is pressed on the pour cup lip 13*d* or at a different pressure from that locally present in the mold in the event vacuum pump 50 is not operational during this time.

The pressure cap 40 is moved away from the pour cup lip 13*d* to the disengaged position shown by dashed lines in FIG. 2 by the aforementioned pivoting mechanism after 2 to 3 or more seconds after filling of the mold or after a pressurization time that is selected as needed for a particular mold.

The present invention is advantageous to reduce amounts of inclusion-forming particles in the melt supplied to the mold cavities by virtue of supplying melt from the bottom of the reservoir and optionally allowing use of suitable molten metal filter(s) without melt flow rate reduction as a result of pressurization of the reservoir. If the mold and pour cup are sealably connected as shown in the FIGS., the invention further aids in filling of fine details in the mold cavities defined by the internal mold surface features and/or core surface features that are otherwise difficult to fill with the melt. The present invention is advantageous in that the pressurizing gas is not introduced into the casting chamber, which can be maintained under relative vacuum (subatmospheric pressure) or at a different pressure from that present in the mold. Localized pressurizing of the pour cup is advantageous to provide higher gas pressure in more rapid time than available when the entire casting chamber is gas pressurized. Moreover, damage to casting furnace components from gas pressurization is reduced with a faster recovery of vacuum in the casting chamber for the next mold to be cast than available when the entire casting chamber is evacuated.

In practicing the invention, the pour cup 13 can used separate from the mold 12 and communicated thereto, for example, by having the loop feed gate 15 aligned or registered with a top opening of the mold 12 so as to supply melt to the mold cavity-forming sections 12*a* from the bottom of the melt in the reservoir. In this embodiment of the invention, filling of the mold cavity-forming sections 12*a* would not be substantially enhanced since the mold and pour cup are not sealable connected, although the advantages of bottom feeding of the melt would be realized.

It is to be understood that the invention has been described with respect to certain specific embodiments thereof for purposes of illustration and not limitation. The present invention envisions that modifications, changes, and the like can be made therein without departing from the spirit and scope of the invention as set forth in the following claims.

We claim:

1. Casting apparatus, comprising a refractory mold disposed in a casting chamber and having one or more mold cavities, a pour cup reservoir communicated to the mold and having a reservoir volume for holding at least enough melt to fill said one or more mold cavities, said melt pour cup reservoir having an inverted loop feed gate that communicates with a lower region of said reservoir and to said one or more mold cavities, said loop feed gate being configured to have a loop region above the melt level in said reservoir to prevent flow of said melt residing in said reservoir to said one or more mold cavities, and means for gas pressurizing said melt in said reservoir to force said melt from said reservoir through said loop feed gate into said one or more mold cavities.

2. The apparatus of claim 1 wherein said means comprises a pressure cap sealingly engaged to said pour cup reservoir for introducing gas pressure on the melt residing in said reservoir, while the casting chamber is maintained under relative vacuum or at a different pressure from that locally present in said reservoir.

3. The apparatus of claim 2 wherein the pressure cap includes a sealing gasket for sealing the pour cup reservoir.

4. The apparatus of claim 1 wherein said inverted loop feed gate communicates with an opening in a bottom wall of said reservoir.

5. A method of casting, comprising disposing a refractory mold in a casting chamber, said mold having one or more mold cavities, introducing a melt into a pour cup reservoir connected to the mold in an amount at least sufficient to fill said one or more mold cavities through an inverted loop feed gate between said reservoir and said one or more mold cavities, preventing flow of said melt from said reservoir through said inverted loop feed gate by controlling the level of said melt in said reservoir, and pressurizing the melt residing in said reservoir to force the melt to flow through said inverted loop feed gate that communicates with a lower region of said reservoir and into said mold cavities to fill them with the melt.

6. The method of claim 5 including removing inclusion-forming particles by floatation to an upper surface of the melt in the reservoir and then feeding melt below said upper surface from said reservoir to said one or more mold cavities.

7. The method of claim 5 including maintaining the casting chamber under relative vacuum or at a different pressure from that locally present in said reservoir.

8. The method of claim 5 wherein the melt residing in said reservoir is forced to flow from a bottom opening of said reservoir through said inverted loop feed gate into said mold cavities to fill them with the melt.

* * * * *